US006301910B1

(12) United States Patent
Noritake et al.

(10) Patent No.: US 6,301,910 B1
(45) Date of Patent: Oct. 16, 2001

(54) REFRIGERATOR

(75) Inventors: Seiichiro Noritake; Kazunori Nishikawa; Yukimori Miyazawa; Yoshihiko Nakajima, all of Nagano (JP)

(73) Assignee: Kabushiki Kaisha Sankyo Seiki Seisakusho, Nagano (JP)

( * ) Notice: Subject to any disclaimer, the term of this patent is extended or adjusted under 35 U.S.C. 154(b) by 0 days.

(21) Appl. No.: 09/361,117

(22) Filed: Jul. 27, 1999

(30) Foreign Application Priority Data

Jul. 29, 1998 (JP) ..... 10-228595

(51) Int. Cl.[7] ..... F25D 17/04
(52) U.S. Cl. ..... 62/187; 62/182
(58) Field of Search ..... 62/186, 187, 414, 62/426, 182; 454/350

(56) References Cited

U.S. PATENT DOCUMENTS 3,791,281 * 2/1974 Steiner ..... 454/350
5,477,699 * 12/1995 Guess et al. ..... 62/187
5,551,252 * 9/1996 Lee ..... 62/187
5,642,628 * 7/1997 Whipple, III et al. ..... 62/186
5,778,694 * 7/1998 Jeong ..... 62/187
5,811,568 * 3/1999 Kim ..... 62/187
5,974,814 * 11/1999 Park et al. ..... 62/187
6,044,659 * 4/2000 Ji ..... 62/186
6,055,820 * 5/2000 Jeong et al. ..... 62/186

* cited by examiner

*Primary Examiner*—Harry B. Tanner
*Assistant Examiner*—Mohammad M. Ali
(74) *Attorney, Agent, or Firm*—Sughrue, Mion, Zinn, Macpeak & Seas, PLLC

(57) ABSTRACT

The refrigerator includes a plurality of rooms separated by partition walls; an air blower to send cooling air cooled by an evaporator into a refrigerator box; a fan motor 65 to drive the air blower; a damper device 50 to adjust an amount of the cooling air of at least one room, of amounts of cooling air flowing into the rooms; and control means 2 and 93 for driving the fan motor 65 without fail just before the baffle of the damper device 50 is opened. The temperature at which the bimetal thermo-switch 2 moves from one terminal 2*a* to the other terminal 2*b*, is set lower than the temperature at which the bimetal thermo-switch 93 moves from the closing terminal 93*b* side to the opening terminal 93*a* side, and the bimetal thermo-switch 2 is made to move to the other terminal 2*b* side before the baffle moves from the close-status to the open-status.

5 Claims, 5 Drawing Sheets

REFRIGERATOR

BACKGROUND OF INVENTION

1. Field of invention

The present invention relates to a refrigerator having a damper device to control taking-in of cooling air and a fan motor to send the cooling air.

2. Related art

Conventionally, a motor type damper device is adopted in a refrigerator (Unexamined Japanese Patent Publication Hei. 6-109354, 9-138052, etc.). A motor type damper device 50 disclosed in Unexamined Japanese Patent Publication Hei. 6-109354, is used for a refrigerator 60 separated into a freezing room 61, a refrigerated room 62 and a vegetable room 63 as shown in FIG. 5. An evaporator 64 is provided on the bottom of the freezing room 61, and a fan motor 65 and an air blower 66 driven by the fan motor 65 are arranged in a rear portion of the evaporator 64. The obtained cooling air is sent to the freezing room 61 or the refrigerated room 62 by the air blower 66. The evaporator 64 absorbs heat of the surroundings when a cooling medium compressed by a compressor 67 is evaporated, and generates cooling air.

A partition plate 68*a* serving as a partition wall is provided between the evaporator 64 and the refrigerated room 62 and shuts off the cooling air of the evaporator 64 directly flowing to the refrigerated room 62. On the other hand, a cooling air flowing path 69 is formed between the rear portion of the partition plate 68*a* and the inner wall of the rear portion of the refrigerator 60, and a damper device 50 is arranged in the cooling air flowing path 69.

When a baffle 52 of the damper device 50 is opened, the cooling air flowing path 69, which is a path of the cooling air, is opened in the form of a clank. The damper device 50 is provided in such manner that it is held by a partition wall 68*b* which is a partition wall forming a portion of the cooling air flowing path 69. In this connection, a damper motor 53 is structured by an AC synchronous motor and conducts the open and close operations of the baffle 52.

Further, a motor type damper device 70 disclosed in Unexamined Japanese Patent Publication Hei. 9-138052, is built in a refrigerator 80 in the form as shown in FIG. 6. Herein, the same members as those shown in FIG. 5 will be shown by the same numerical codes as those in FIG. 5, and the explanation will be omitted.

In this refrigerator 80, a duct 81 whose both ends are opened so as to send the cooling air to the vegetable room 63, is formed as shown in FIG. 6, and a motor type damper device 70 is fitted in a portion leading into the vegetable room 63 in the duct 81. That is, this damper device 70 is fitted in such that a frame 71 of the damper device 70 forms a portion of the duct 81, and the damper device 70 itself serves also as the duct 81. In this connection, the drive source of the motor type damper device 70 is a stepping motor, and opens and closes the baffle 72.

In the refrigerators 60 and 80 using the motor type damper devices 50 and 70, these damper device 50 and 70 are operated by temperature sensors in the refrigerated room 62 and vegetable room 63. Concretely, the refrigerators are controlled by a control circuit 91 as shown in FIG. 7. That is, the fan motor (FM) 65 is connected in parallel to the compressor (CP) 67 to operate the evaporator 64, and both members 65 and 67 are controlled by a thermo-switch 92 for the freezing room 61. On the other hand, in the refrigerated room 62, a bimetal thermo-switch 93 for the damper is provided, and the motor type damper device 50 is connected to it. The bimetal thermo-switch 93 for the damper has an open-terminal 93*a* to open the baffle 52 of the damper device 50 so as to take in the cooling air when the room temperature is higher than a setting temperature value, and a close-terminal 93*b* to close the baffle 52 so as to shut off the cooling air when the room temperature is lower than a setting value which is set lower than the above-described setting temperature value.

The motor type damper device 50 has a damper motor 94 structured by an AC synchronous motor or a stepping motor; a close-operation switch 95 which supplies a current to the damper motor 94 until, when the bimetal thermo-switch 93 contacts the closing terminal 93*b* side, the baffle 52 of the damper device 50 is operated in the closing direction and the baffle is fully closed, and which is opened and stops the current supply when the baffle 52 is closed; and an open-operation switch 96 which is interlocked with the close-operation switch 95 simultaneously when it is opened, and which conducts an on-operation, that is, close operation.

Incidentally, the structure and operations of the motor type damper device 70 are also the same as those of the motor type damper device 50, and therefore, the explanation will be omitted.

The conventional refrigerators 60 and 80 having the motor type damper devices control the motor type damper devices 50 and 70 by the bimetal thermo-switch 93, or the like, in the refrigerated room 62 or vegetable room 63. However, only making the motor type damper devices 50 and 70 on and off, it is difficult to conduct the cooling of the refrigerated room 62 or vegetable room 63 at high speed.

For example, in the case where the fan motor 65 provided on the rear portion of the evaporator 64 is operated, when the baffle 52 of the motor type damper device 50 for the refrigerated room 62 is opened, the temperature of the refrigerated room 62 is quickly lowered and reaches a predetermined value soon. However, in the case where the fan motor 65 is not operated, even if the motor type damper device 50 is opened, the cooling air hardly enters into the refrigerated room 62. Accordingly, in this case, it requires a long period of time to cool down the temperature to a predetermined value.

SUMMARY OF INVENTION

The present invention is accomplished to solve the above problems, and the object of the present invention is to provide a refrigerator which can cool rooms in the refrigerator surely and quickly by using the damper device.

In order to solve the above-described problems, a refrigerator of the present invention comprises: a plurality of rooms separated by partition walls; an air blower to send cooling air cooled by an evaporator into a refrigerator box; a fan motor to drive the air blower; a damper device to adjust a cooling air amount flowing into at least one of the plurality of rooms; and a control means for driving the fan motor just before the baffle of the damper device is opened.

Further, a refrigerator of the present invention comprises: a plurality of rooms separated by partition walls; a compressor to operate an evaporator to cool inside the refrigerator box; the first temperature sensor to detect the temperature of the first room cooled by the evaporator and to on-off control the compressor; a damper device to adjust an amount of the cooling air flowing into the second room which is different from the first room; the second temperature sensor to detect the temperature of the second room in order to control the open and close of a baffle of the damper device; an air blower to feed the cooling air cooled by the evaporator into the refrigerator box; a fan motor to drive the air blower; and the third temperature sensor which operates so as to drive the fan motor just before, or simultaneously with, or just after the open operation of the baffle of the damper device, is connected to the fan motor in series.

Further, a refrigerator of the present invention comprises: a plurality of rooms separated by partition walls; a compressor to operate an evaporator to cool inside the refrigerator box; an air blower to send cooling air cooled by the evaporator into a refrigerator box; a fan motor to drive the air blower; a damper device to adjust an amount of a cooling air of at least one room of the amounts of cooling air flowing into the plurality of rooms; and a control means for driving the fan motor when the baffle of the damper device is opened.

In such structured refrigerator of the present invention, a flowing amount of the cooling air into one room is not only adjusted by the damper device, but the fan motor to send the cooling air into the refrigerator box is also driven just before the baffle of the damper device is moved from the close to open status. Therefore, when the baffle is opened and the cooling air flows into the room, the cooling air is introduced by the fan motor, thereby, the room temperature controlled by the damper device can be surely and quickly lowered.

Further, an amount of the cooling air flowing into the second room may be adjusted by the third temperature sensor which operates to drive the fan motor at the timing when the baffle of the damper device is opened, that is, just before, or simultaneously with, or just after the open operation of the baffle. According to this, when the baffle is opened, the fan motor is driven without fail, thereby, a large amount of the cooling air can be introduced into the second room.

Furthermore, if the fan motor is driven without fail when the baffle of the damper device is opened, the more cooled cooling air passes the damper device, and can vigorously enter into the room to be cooled.

DETAILED DESCRIPTION OF PREFERRED EMBODIMENTS

Figure 1:
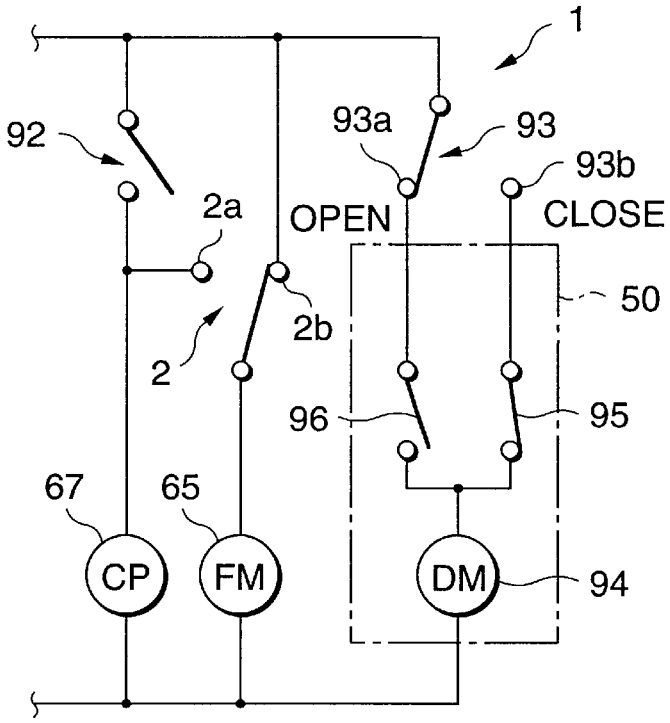
FIG. 1 is a circuit diagram of a main portion showing a main portion of a circuit of a refrigerator in the first embodiment of the present invention.

Referring to FIGS. 1 through 4, embodiments of the present invention will be described, and initially, referring to FIG. 1, the first embodiment will be described below.

Figure 5:
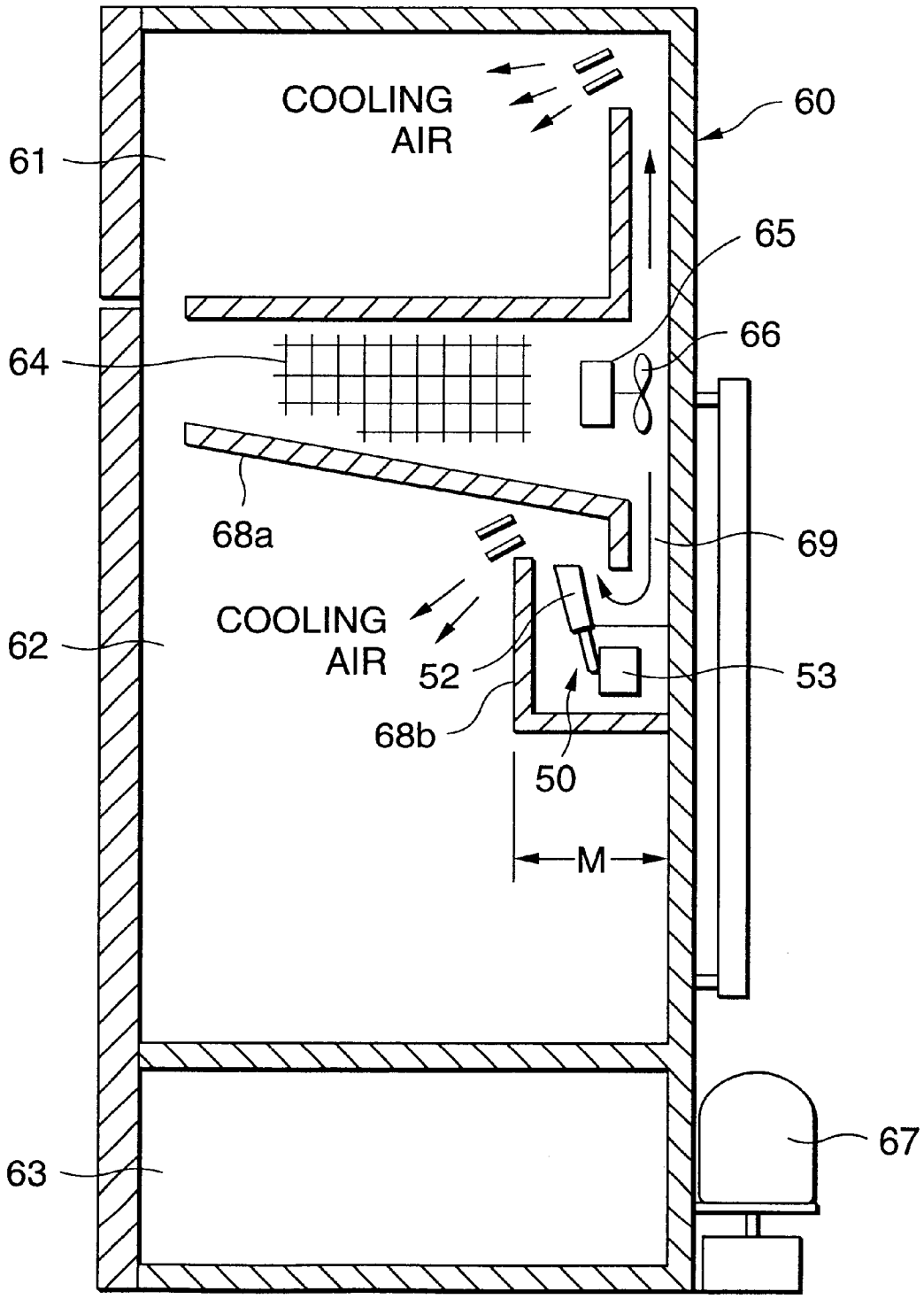
FIG. 5 is a sectional view of the refrigerator in which a motor type damper device used in the conventional and the present invention, is built.
Figure 6:
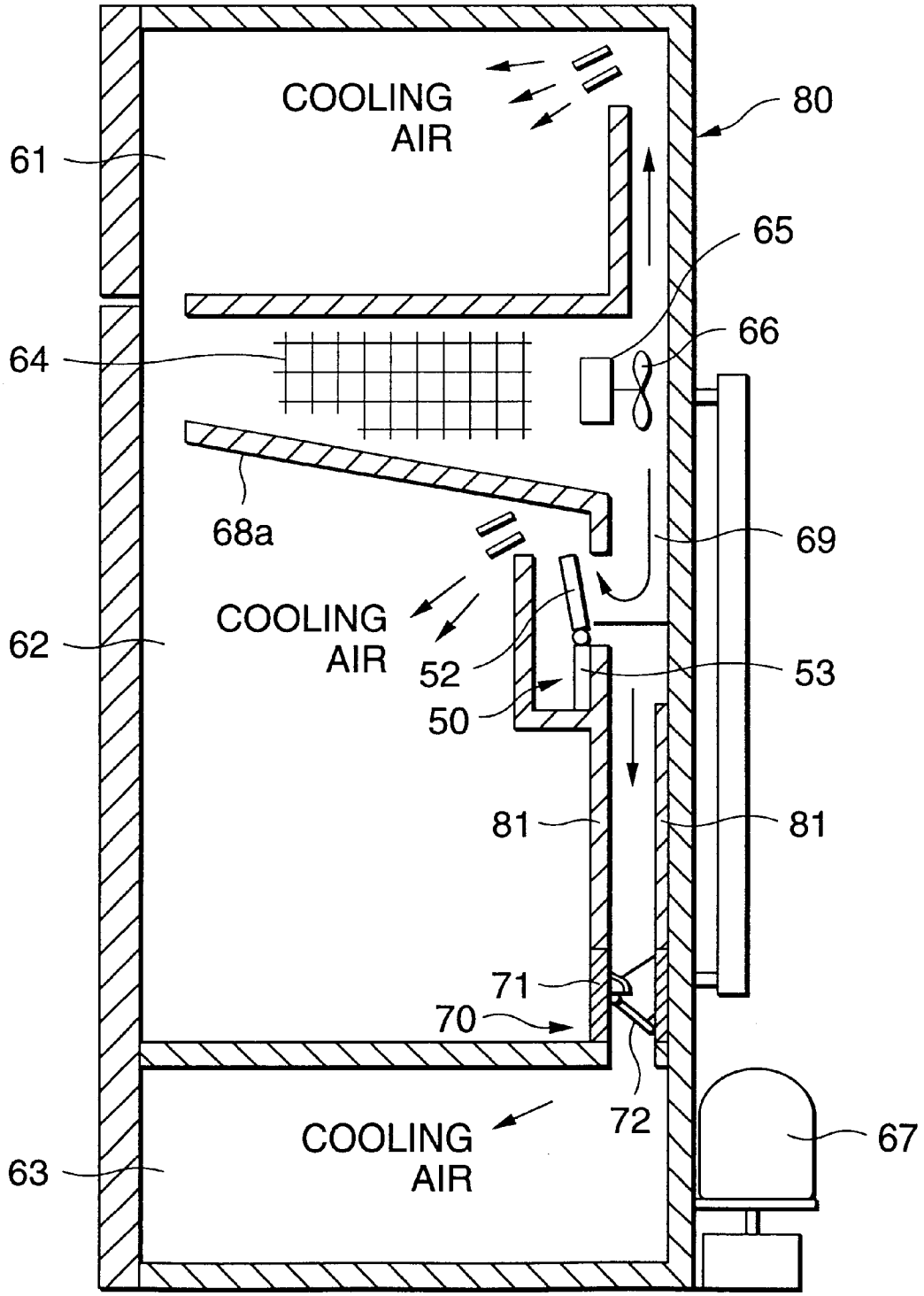
FIG. 6 is a sectional view of the refrigerator in which another motor type damper device used in the conventional and the present invention, is built.
Figure 7:
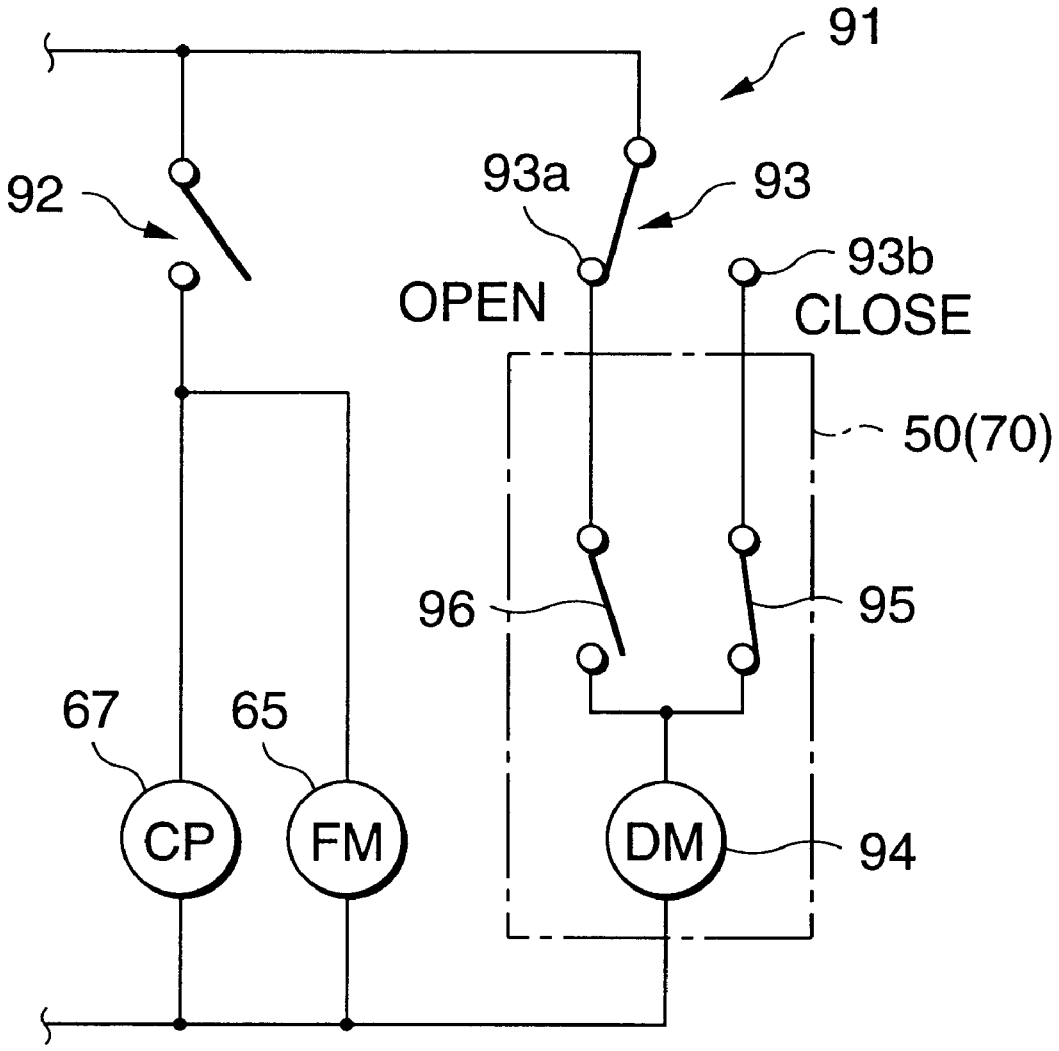
FIG. 7 is a circuit diagram of a main portion showing a main portion of a circuit of the conventional refrigerator.

Incidentally, a refrigerator described in each embodiment is that having the same structure as the refrigerators 60 and 80 as shown in FIGS. 5 and 6, and has a plurality of rooms separated by partition walls, for example, a freezing room, refrigerated room, and vegetable room. Further, a motor type damper device is used as the damper device. As described above, the refrigerator of the present invention only has different circuit structures from the refrigerators 60 and 80 shown in FIGS. 5 and 6, and the other structure is the same, and therefore, only the circuit structure will be explained in the following description and the same numerical symbols will be used for the same members.

In the circuit 1 of the refrigerator in the first embodiment, (the first circuit), as shown in FIG. 1, a thermo-switch 92 serving as the first temperature sensor and a compressor (CP) 67 to operate the evaporator are connected in series to the AC power supply. Further, in parallel to these members, a bimetal thermo-switch 93 for the damper device, serving as the second temperature sensor, and a motor type damper device 50 are connected in series. Herein, the thermo-switch 92 is used for controlling the freezing room 61 serving as the first room, and installed in the freezing room 61, and is on-status when the temperature of the freezing room 61 is higher than a predetermined value, and drives the compressor 67 for cooling the freezing room 61.

The fan motor 65 is connected in series to the bimetal thermo-switch 2 for the fan motor, which is the third temperature sensor. One terminal 2*a* of two terminals on the power supply side of the bimetal thermo-switch 2 is connected to a portion between the thermo-switch 92 and the compressor 67, and the other terminal 2*b* is directly connected to the power supply.

The bimetal thermo-switch 2 is used for controlling the refrigerated room, which is the second room, in the same manner as the bimetal thermo-switch 93, and is installed in the refrigerated room 62, and its setting temperature for switching the operation on high temperature side is set lower than that of the bimetal thermo-switch 93. That is, the setting temperature at which the bimetal thermo-switch 2 is switched from one terminal 2*a* to the other terminal 2*b* side, is set lower than that at which the bimetal thermo-switch 93 is switched from the closing terminal 93*b* side to the opening terminal 93*a*. Accordingly, before the temperature inside the refrigerated room 62 is increased and the baffle 52 is driven from the close status to the open status, the bimetal thermo-switch 2 is switched to the other terminal 2*b* side, therefore, the fan motor 65 is initially driven before the baffle 52 is driven from the close-status to the open-status.

On the other hand, the operation setting temperature on the low temperature side of the bimetal thermo-switch 2 is set at the same as, or a little higher than that of the bimetal thermo-switch 93. According to this, simultaneously with or just before the bimetal thermo-switch 93 is moved from the opening terminal 93*a* side to the closing terminal 93*b*, the bimetal thermo-switch 2 is moved surely to the other terminal 2*a* side. That is, the bimetal thermo-switch 2 and the bimetal thermo-switch 93 structure the control means by which the fan motor 65 is driven without fail just before the baffle 52 of the damper device 50 is opened.

Next, operations of the refrigerator in this first embodiment will be described.

When the temperature in the freezing room 61 is increased, the thermo-switch 92 becomes on, and the compressor 67 starts its operation. When the temperature at which the thermo-switch 92 is on, is set at, for example, −10° C., if the temperature of the freezing room 61 is higher than −10° C., the compressor 67 is operated, and starts the cooling of the freezing room 61.

Apart from the freezing room 61, the room temperature of the refrigerated room 62 moves up and down. According to the room temperature of the refrigerated room 62, bimetal thermo-switches 2 and 93 are operated. For example, the setting temperature on the high temperature side of the bimetal thermo-switch 93 is 5° C., and that on the low temperature side is 1° C., and further, the setting temperature on the high temperature side of the bimetal thermo-switch 2 is 4° C., and that on the low temperature side is 2° C.

Herein, the current temperature of the refrigerated room 62 is assumed to be 2° C., or so. In this case, the bimetal thermo-switch 2 is connected to one terminal 2*a*. Therefore, on this state, when the thermo-switch 92 is turned on, the fan motor 65 is also operated simultaneously with the compressor 67. On the other hand, when the temperature of the refrigerated room 62 is 2° C., or so, the baffle 52 is closed, and the bimetal thermo-switch 93 is connected to the closing terminal 93*b*. Accordingly, in this case, the close-operation switch 95 is turned off, and the open-operation switch 96 is turned on.

When the temperature of the refrigerated room 62 is gradually increased and exceeds 4° C., because the setting temperature on the high temperature side of the bimetal thermo-switch 2 is 4° C., the bimetal thermo-switch 2 is connected to the other terminal 2*b* side, and drives the fan motor 65 independently of on/off of the thermo-switch 92. After that, when the temperature of the refrigerated room 62 is further increased and exceeds 5° C., because the setting temperature on the high temperature side of the bimetal thermo-switch 93 is 5° C., the connecting terminal of the bimetal thermo-switch 93 is moved from the closing terminal 93*b* side to the opening terminal 93*a* side. In this case, because the open-operation switch 96 is on, the damper motor 94 starts its driving, and the baffle 52 of the motor type damper device 50 is moved from the close direction to the open direction, and the cooling air enters into the refrigerated room 62. When the baffle 52 is opened, the open-operation switch 96 is turned off, and simultaneously, the close-operation switch 96 is turned on. FIG. 1 shows the circuit condition at that time.

When the baffle 52 starts to be opened, because the fan motor 65 is operated already, the cooling air quickly enters into the refrigerated room 62 by aid of the air blower 66. Thereby, the temperature in the refrigerated room 62 is quickly lowered. When the temperature in the refrigerated room 62 is decreased lower than 2° C., because the temperature setting on the low temperature side of the bimetal thermo-switch 2 is 2° C., the contact terminal of the bimetal thermo-switch 2 is moved to one terminal 2*a* side. At this time, when the thermo-switch 92 is on, the fan motor 65 is continuously driven, however, when the thermo-switch 92 is off, the drive of the fan motor 65 is stopped. However, because the baffle 52 is opened, the flow of the cooling air cooled by the evaporator 64 into the refrigerated room 62 is continued.

When the temperature in the refrigerated room 62 is decreased lower than 1° C., because the temperature setting on the low temperature side of the bimetal thermo-switch 93 is 1° C., the bimetal thermo-switch 93 is moved to the closing terminal 93*b* side. Then, the damper motor 94 starts its operation, and drives the baffle 52 to the close direction. When the baffle 52 is completely closed, the close-operation switch 95 is turned off and simultaneously, the open-operation switch 96 is turned on. When the baffle 52 is closed, the temperature of the refrigerated room 62 is not lowered any more and starts to increase again in the passage of time, and the above-described operations are repeated.

In this first circuit 1, just before the baffle 52 is changed from the close-status to the open-status, that is, when the temperature of the refrigerated room 62 is 4° C., which is a condition before the refrigerated room 62 is cooled, the fan motor 65 is driven. Therefore, when the baffle 52 starts the open-operation, the cooling air enters soon. As the result, the refrigerated room 62 can be quickly and surely cooled.

Figure 2:
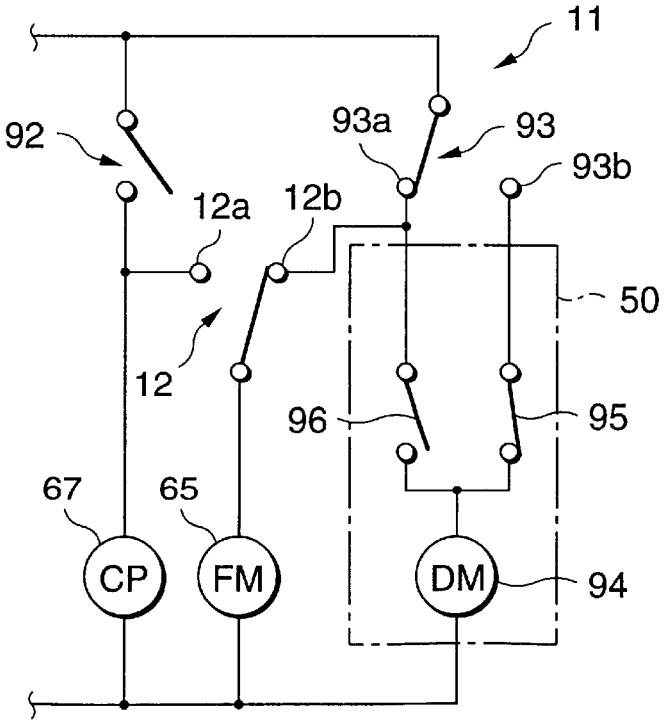
FIG. 2 is a circuit diagram of a main portion showing a main portion of a circuit of a refrigerator in the second embodiment of the present invention.

Next, referring to FIG. 2, a circuit 11 of the refrigerator (hereinafter, referred to as the second circuit) in the second embodiment will be described. In this connection, the same members as those shown in FIG. 1 are denoted by the same numeral codes, and the explanation for them will be omitted.

The second circuit 11 has almost the same structure as that of the foregoing first circuit 1, and the different point from the first circuit 1 is the connection structure of a bimetal thermo-switch 12 serving as the third temperature sensor. In this second circuit 11, the other terminal 12*b* corresponding to the other terminal 2*b* in the first circuit 1, is connected to an intermediate portion between the opening terminal 93*a* of the bimetal thermo-switch 93 for the damper and the open-operation switch 96. In this connection, one terminal 12*a* is connected to the same portion as in the case of one terminal 2*a* in the first circuit 1.

The temperature setting of temperature sensors 12, 92 and 93 in the second circuit 11 is the same as in the first circuit 1. Accordingly, just before the baffle 52 is turned from the close-status to the open-status, that is, when the temperature of the refrigerated room 62 exceeds 4° C., the bimetal thermo-switch 12 is connected to the other terminal 12*b* side. However, in this condition, the bimetal thermo-switch 93 serving as the second temperature sensor is not connected to the opening terminal 93*a* side, therefore, the fan motor 65 does not start to drive at once. Then, when the temperature of the refrigerated room 62 is 5° C., and the bimetal thermo-switch 93 serving as the second temperature sensor is connected to the opening terminal 93*a* side, the damper motor 94 starts to drive and simultaneously the fan motor 65 starts to drive. Accordingly, as the damper motor 94 starts the drive and the baffle 52 of the motor type damper device 50 is operated from the close direction to the open direction, and the baffle 52 is opened, the cooling air enters into the refrigerated room 62, thereby, the cooling air can be introduced into the refrigerated room 62 before the baffle 52 is completely closed.

Incidentally, until the baffle 52 of the motor type damper device 50 is turned from the close status to the complete open status, although it is different depending on the difference of setting mode, normally, it takes several seconds to several tens of seconds. Therefore, although it is not preferable in the cooling speed that the cooling air is started to flow after the baffle 52 is completely opened, in the refrigerator in the above embodiment, as the baffle 52 is opened, the cooling air can be entered into the refrigerated room 62. Accordingly, the cooling air can be quickly introduced into the refrigerated room 62, as compared with the case where the fan motor is started to be driven after the baffle 52 is completely opened.

In the above-described first circuit 1 and second circuit 11, both are the circuits in which the conventional structure of the motor type damper device 50 is used without any change, therefore, it is not necessary to change the structure of the motor type damper device 50. Accordingly, the motor type damper device 50 can be structured at low cost, and the structure is not complicated, thereby, its quality is stable.

Figure 3:
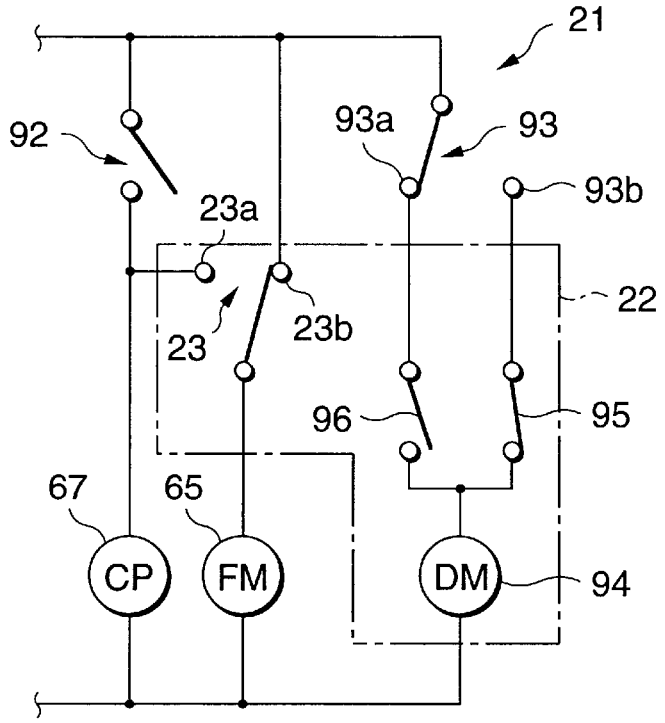
FIG. 3 is a circuit diagram of a main portion showing a main portion of a circuit of a refrigerator in the third embodiment of the present invention.

Next, referring to FIG. 3, a circuit 21 of the refrigerator (hereinafter, referred to as the third circuit) in the third embodiment will be described. In this connection, the same members as those shown in FIG. 1 are denoted by the same numeral codes, and the explanation for them will be omitted.

The third circuit 21 is different from the internal circuit structure of the motor type damper device 50 in the first circuit 1 and the second circuit 11, and a changeover switch for the fan motor is built in the damper device 22. Concretely, in the motor type damper device 22, the damper motor 94, the close-operation switch 95 and the open-operation switch 96, which are the same as those in the first circuit 1, are arranged, and further, a changeover switch 23 for the fan motor is arranged.

The changeover switch 23 is set in such a manner that the connection is switched from one terminal 23*a* to the other terminal 23*b* before the timing in which the baffle 52 is completely opened and the open-operation switch 96 is off (open), and the fan motor 65 is driven before the baffle 52 is completely opened. Therefore, while the baffle 52 is operated to be opened, the cooling air is started to be introduced into the refrigerated room 62 by the fan motor 65, and thereby, the refrigerated room 62 can be cooled at high speed.

The operation of the changeover switch 23 preceding the condition in which the baffle 52 is completely opened, can be obtained as follows: a switching cam to switch the switches 95 and 96, which are provided in the motor type damper device 22 and switch the on/off conditions when the baffle 52 is completely opened or closed, is integrated with a cam for the fan motor in which the switching position slightly precedes the switching cam, and both cams are integrally driven by the damper motor 94. In this connection, it is necessary that the changeover switch 23 is connected to the other terminal 23*b* while the baffle 52 is moved toward the open direction, however, it is not necessarily required that the changeover switch 23 is connected to one terminal 23*a* side while the baffle 52 is moved toward the close direction, and the changeover switch 23 may be changed to one terminal 23*a* side simultaneously when the baffle 52 is completely closed, that is, simultaneously when the close-operation switch 95 is turned off.

In the third circuit 21, the fan motor 65 is started to be driven being interlocked with the movement of the baffle 52, and before the baffle 52 is completely opened, thereby, the cooling speed is increased. Further, the changeover switch 23 connected to the fan motor 65 is provided in parallel to the circuit for the motor type damper device 22 and the circuit composed of the bimetal thermo-switch 93, therefore, each kind of constants of the conventional circuit can be used as they are, and portions to be changed in the design may be small.

Figure 4:
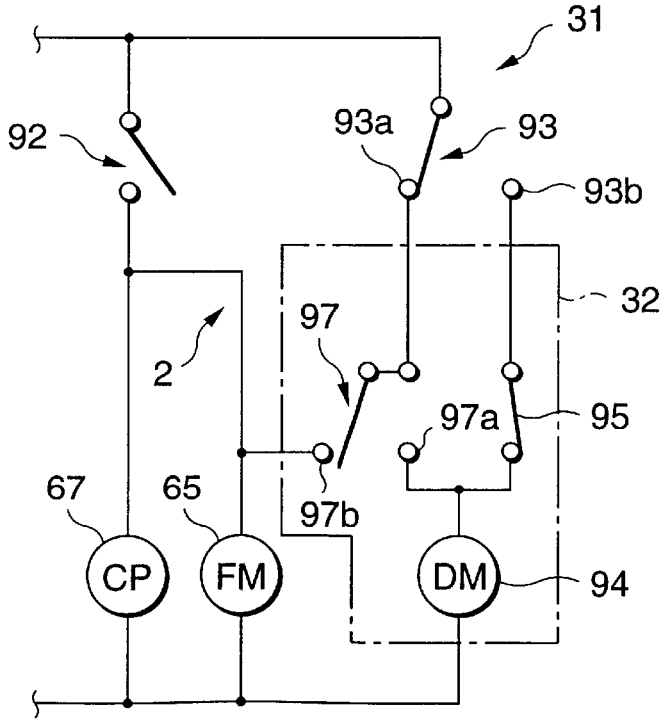
FIG. 4 is a circuit diagram of a main portion showing a main portion of a circuit of a refrigerator in the fourth embodiment of the present invention.

Next, referring to FIG. 4, a circuit 31 of the refrigerator (hereinafter, referred to as the fourth circuit) in the fourth embodiment will be described. In this connection, the same members as those shown in FIG. 1 are denoted by the same numeral codes, and the explanation for them will be omitted.

This fourth circuit 31 has a motor type damper device 32 which is more different from that in the third circuit 21. In this motor type damper device 32, the damper motor 94 and the close-operation switch 95, which are the same as those in the third circuit 21, are arranged. On the other hand, an open-operation switch 97, which is different from the open-operation switch 96 in the third circuit 21, is arranged.

This open-operation switch 97 is connected to a terminal 97*a* of the damper motor 94 when the bimetal thermo-switch 93 is switched to the opening terminal 93*a* side, and drives the damper motor 94. Then, when the baffle 52 is completely opened, the open-operation switch 97 is switched to a terminal 97*b* of the fan motor 65 side. Simultaneously with this switching, the close-operation switch 95 is turned from off to on, in the same manner as in the third circuit 21. In this connection, the terminal 97*b* is connected to a portion between the fan motor 65 and the thermo-switch 92.

In this fourth circuit 31, the compressor 67 and the fan motor 65 are started to operate without fail, simultaneously when the baffle 52 is opened and then completely opened, therefore, the compressor 67 is operated and the cooling air is obtained, and the cooling air can be sent into the refrigerated room 62 by the air blower 66. Therefore, the cooling of the refrigerated room 62 can be surely and quickly conducted.

Incidentally, the above-described embodiments are examples of preferred embodiments of the present invention, however, the present invention is not limited to these, and various variations can be made within the range without departing from the spirit of the present invention. For example, instead of the motor type damper device, another type such as an oil type or solenoid type damper device may be allowable. Further, as the temperature sensor and switch, other than the thermo-switch 92 or bimetal thermo-switches 93, 2, and 12, the temperature is measured by a thermistor, or a thermoelectric couple, and according to the detection result, a switch such as a TRIAC or the like, may be controlled.

Further, in the third circuit 21, the fan motor 65 is not started to be driven before the baffle 32 is completely opened, but the operation of the fan motor 65 may be started simultaneously when the baffle 32 is completely opened. In this case, the start of driving of the fan motor 65 can not necessarily be conducted during the opening operation of the baffle 52, however, when the baffle 52 is completely opened, the fan motor 65 can be driven without fail, thereby, the cooling speed can be always made high, as compared with the case where the fan motor 65 is driven independently of the condition in which the baffle 52 is completely opened as the conventional technology.

Furthermore, in the above-described embodiments, the damper motor 94 is the AC synchronous motor driven by the AC power supply, however, when the AC power supply is converted into the DC power supply, a DC motor such as a stepping motor, or the like, can be adopted.

Further, as the room in which the damper device is used, the freezing room, refrigerated room, vegetable room, and other necessary rooms may be appropriately set. Furthermore, not only one damper device, but each one damper device for each of the plurality of rooms in the refrigerator, a plurality of damper devices, or damper devices, whose number is smaller than the number of rooms, may be employed. Still further, a double damper device which has two baffles in each damper device, may be provided.

As described above, in the refrigerator of the present invention, because the fan motor for feeding the cooling air is driven just before the baffle of the damper device is opened, the room controlled by the damper device can be surely and quickly cooled.

Further, in the refrigerator of the present invention, the first temperature sensor controls the compressor, the second temperature sensor controls the damper device, and the third temperature sensor drives the fan motor just before, simultaneously, or just after the baffle of the damper device is opened. Therefore, the air blower driven by the fan motor is synchronized with the movement of the baffle, thereby, the high speed cooling can be conducted.

Still further, in the refrigerator of the present invention, when the baffle of the damper device is completely opened, the fan motor, or the compressor and the fan motor are driven. Thereby, a large amount of the fully cooled cooling air can be sent to the room controlled by the damper device, and high speed cooling can be conducted.

What is claimed is:

1. A refrigerator comprising:

a plurality of rooms separated by partition walls;

an air blower for sending cooling air cooled by an evaporator into a refrigerator box;

a fan motor for driving the air blower;

a damper device provided with a open/close baffle to adjust the cooling air flowing into at least one of the plurality of rooms; and a control means for driving the fan motor just before the baffle of the damper device is opened, wherein the fan motor is driven just before the baffle is opened, and when the baffle is opened, the cooling air flows into the room by the air blower.

2. The refrigerator according to claim 1, further comprising:

a temperature sensor to detect the temperature of the room, into which the flow of the cooling air is controlled by the damper device, said temperature sensor being provided in order to control the open and close of the baffle of the damper device;

wherein the temperature sensor is structured by a bimetal thermo-switch, and is connected to the damper device in series, and the fan motor is driven by the bimetal thermo-switch before the baffle is started to open.

3. The refrigerator according to claim 1, wherein a first temperature sensor to detect the temperature of a freezing room cooled by the evaporator and to on-off control a compressor, a second temperature sensor to detect the temperature of the room into which a flow of the cooling air is controlled by the damper device, and a third temperature sensor which operates to drive the fan motor, are provided; wherein the first temperature sensor is a thermo-switch connected to the compressor in series, the second temperature sensor is a bimetal thermo-switch connected to the damper device in series, and the third temperature sensor is a bimetal thermo-switch whose one terminal is a terminal connected to the compressor and whose other terminal is directly connected to a power supply, and wherein the temperature for switching two bimetal thermo-switches is set in such a manner that the fan motor is driven before the baffle starts its open-operation.

4. A refrigerator comprising:

a plurality of rooms separated by partition walls;

a compressor to operate an evaporator to cool inside a refrigerator box;

an air blower to feed cooling air cooled by the evaporator into the refrigerator box; and a fan motor to drive the air blower;

a damper device to adjust a cooling air amount of at least one room of amounts of the cooling air flowing into the plurality of rooms; and a control means for driving the fan motor when a baffle of the damper device is opened, wherein the control means has a first cam, built in the damper device, to detect an open and close status of the baffle and a second cam to operate a changeover switch for the fan motor, the first and second cams are driven by a damper motor to open and close the baffle and the changeover switch for the fan motor drives the fan motor when the baffle of the damper device is opened.

5. The refrigerator according to claim 4, wherein the operation of the changeover switch for the fan motor is set within a time period from the time when the baffle of the damper device starts the open operation to the time when the baffle is fully opened.

* * * * *